US010851801B2

(12) United States Patent
Grigoriev et al.

(10) Patent No.: US 10,851,801 B2
(45) Date of Patent: Dec. 1, 2020

(54) CENTRIFUGAL COMPRESSOR SYSTEM AND DIFFUSER

(71) Applicant: Ingersoll-Rand Company, Davidson, NC (US)

(72) Inventors: Mikhail M. Grigoriev, East Amherst, NY (US); William T. Tierney, Cheektowaga, NY (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 195 days.

(21) Appl. No.: 15/910,660

(22) Filed: Mar. 2, 2018

(65) Prior Publication Data

US 2019/0271328 A1 Sep. 5, 2019

(51) Int. Cl.
*F04D 29/44* (2006.01)
*F04D 17/10* (2006.01)

(52) U.S. Cl.
CPC ..... *F04D 29/444* (2013.01); *F04D 17/10* (2013.01)

(58) Field of Classification Search
None
See application file for complete search history.

(56) References Cited

U.S. PATENT DOCUMENTS 2,490,066 A 8/1945 Kollsman
4,027,997 A 6/1977 Bryans
4,060,337 A * 11/1977 Bell ..... F04D 29/284 416/186 R
5,145,317 A * 9/1992 Brasz ..... F04D 29/444 415/203
5,228,832 A * 7/1993 Nishida ..... F04D 17/06 415/208.1
6,435,828 B1 8/2002 Bostwick
6,629,818 B2 10/2003 Svoboda
6,644,923 B1 11/2003 Fine et al.
8,444,370 B2 5/2013 Gülich
8,475,131 B2 7/2013 Shibata et al.
8,596,968 B2 12/2013 Emmerson
8,616,836 B2 12/2013 Blair et al.
8,926,276 B2 1/2015 Japikse
9,222,485 B2 12/2015 Brown et al.
2007/0059170 A1 3/2007 Xu et al.
2010/0166539 A1* 7/2010 Ibaraki ..... F04D 29/4206 415/148
2011/0002780 A1* 1/2011 Higashimori ..... F04D 29/284 415/203
2011/0194931 A1* 8/2011 Swiatek ..... F04D 29/444 415/206

(Continued)

OTHER PUBLICATIONS

International Search Report and Written Opinion, International Patent Application No. PCT/US2019/020325, dated Jun. 3, 2019, 9 pages.

*Primary Examiner* — Michael Lebentritt
(74) *Attorney, Agent, or Firm* — Taft Stettinius & Hollister LLP

(57) ABSTRACT

A centrifugal compressor system includes a centrifugal impeller a shroud in cooperative engagement with the impeller; and a diffuser. The diffuser has a hub surface; a shroud surface; a plurality of diffuser vanes extending between the hub surface and the shroud surface; and a common splitter ring disposed between the hub surface and the shroud surface and intersecting each of the diffuser vanes along a span of each of the diffuser vanes.

20 Claims, 3 Drawing Sheets

(56) References Cited

U.S. PATENT DOCUMENTS

| | | | | |
|---|---|---|---|---|
| 2012/0121432 | A1* | 5/2012 | Wakai | F04D 29/284 416/243 |
| 2012/0294703 | A1 | 11/2012 | Lei et al. | |
| 2013/0094955 | A1* | 4/2013 | Ibaraki | F04D 29/444 415/207 |
| 2014/0064953 | A1 | 3/2014 | Swiatek et al. | |
| 2014/0328676 | A1 | 11/2014 | Robson et al. | |
| 2015/0159670 | A1 | 6/2015 | Saito | |
| 2015/0275917 | A1* | 10/2015 | Fukuyama | F04D 27/0253 415/148 |
| 2015/0308446 | A1 | 10/2015 | Koivikko et al. | |
| 2016/0108920 | A1* | 4/2016 | Yamashita | F04D 17/10 415/204 |
| 2016/0319833 | A1* | 11/2016 | Rubino | F04D 29/284 |
| 2017/0276142 | A1* | 9/2017 | Graham | F04D 29/023 |
| 2017/0298942 | A1 | 10/2017 | Kuno et al. | |
| 2018/0306203 | A1 | 10/2018 | Nasir et al. | |

* cited by examiner

CENTRIFUGAL COMPRESSOR SYSTEM AND DIFFUSER

TECHNICAL FIELD

The present application generally relates to compressors and more particularly, but not exclusively, to a centrifugal compressor system with a diffuser.

BACKGROUND

Compressor systems of various types, e.g., centrifugal compressor systems remain an area of interest. Some existing systems have various shortcomings, drawbacks and disadvantages relative to certain applications. For example, in some centrifugal compressor systems, improvements in efficiency may be obtained. Accordingly, there remains a need for further contributions in this area of technology.

SUMMARY

One embodiment of the present invention is a unique centrifugal compressor system. Another embodiment is a unique diffuser for a centrifugal compressor system. Other embodiments include apparatuses, systems, devices, hardware, methods, and combinations for centrifugal compressor systems and diffusers for centrifugal compressor systems. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
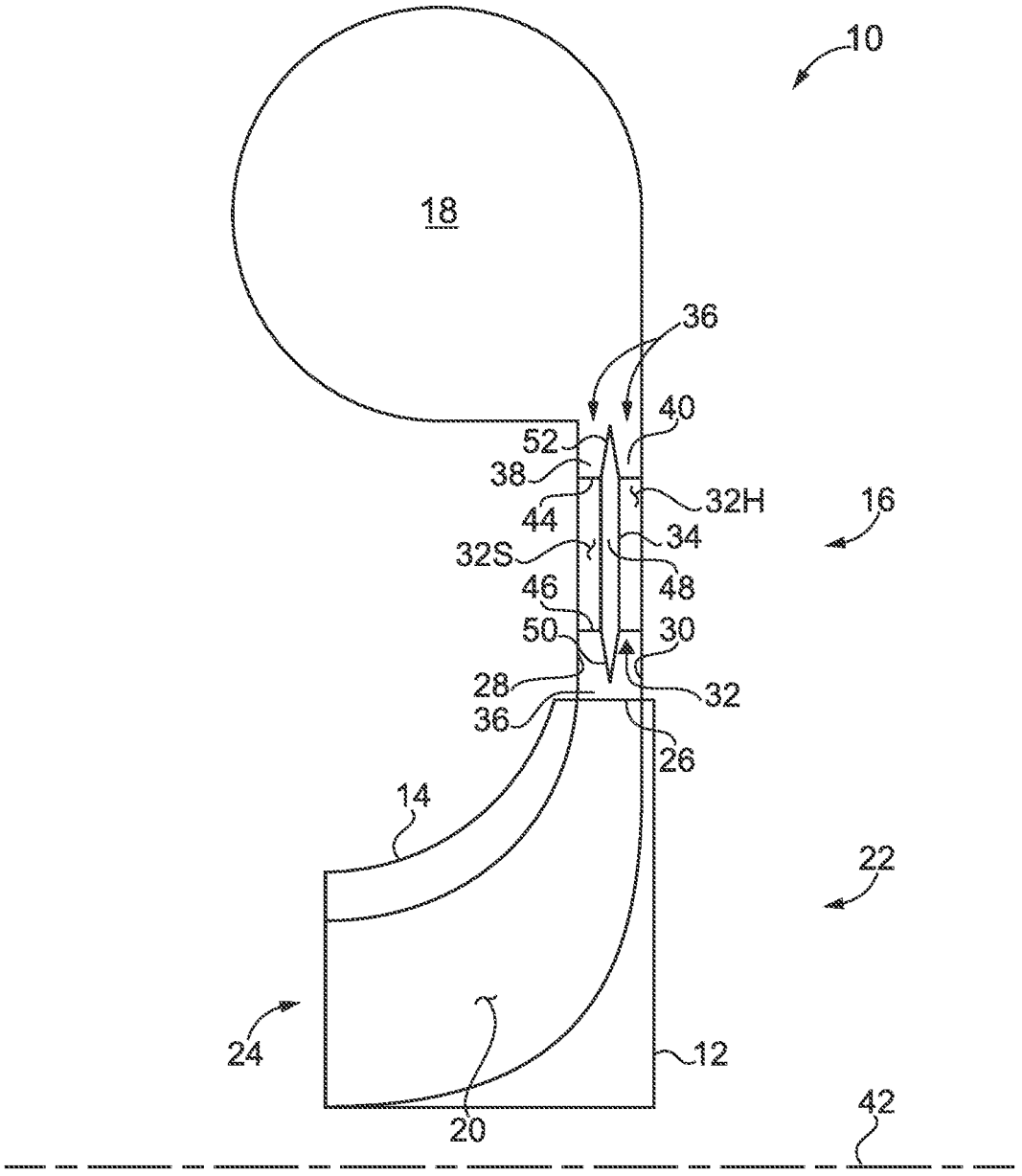
FIG. 1 schematically illustrates some aspects of a non-limiting example of a centrifugal compressor system in accordance with an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
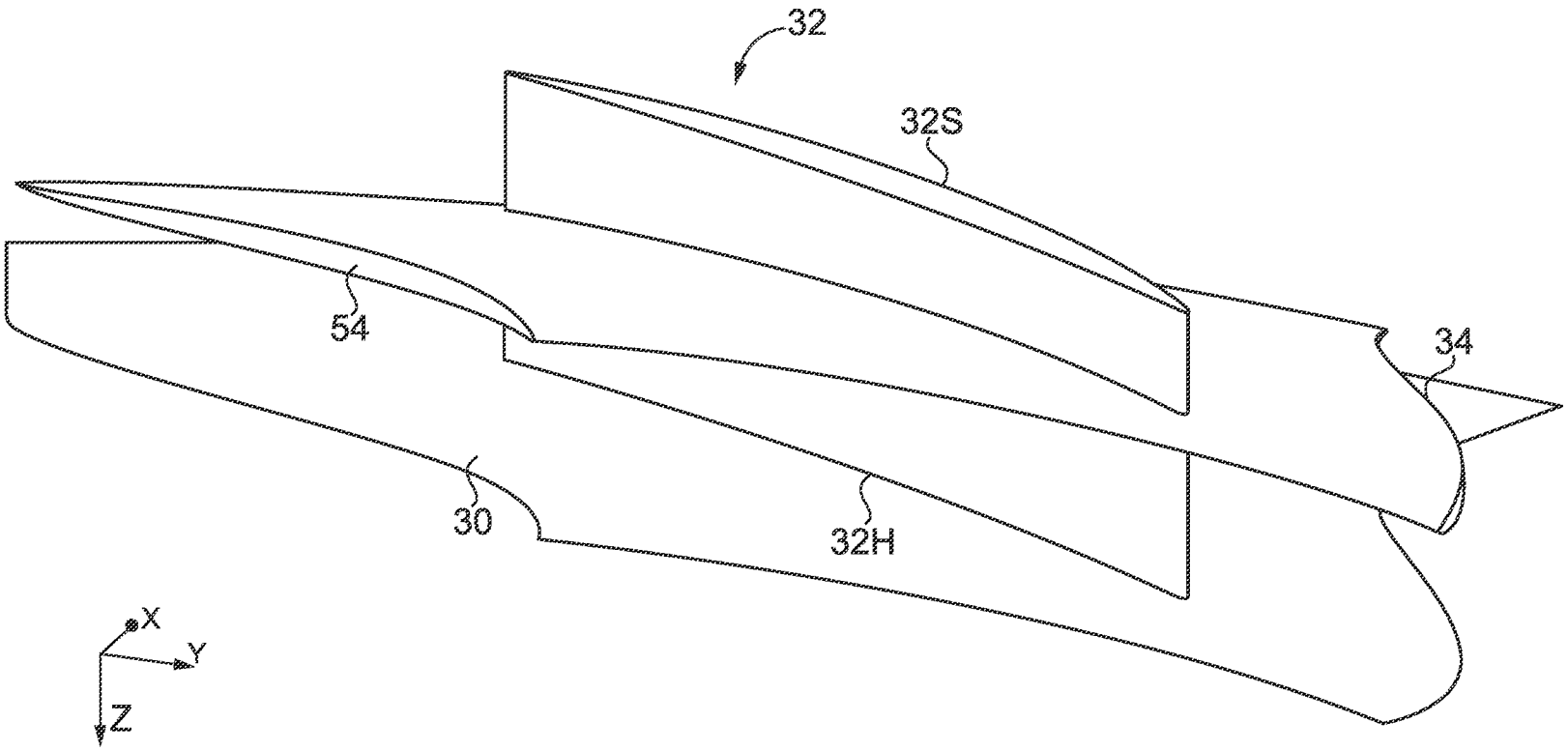
FIG. 2 illustrates some aspects of a non-limiting example of a common splitter ring having an airfoil-shaped cross-section in accordance with an embodiment of the present invention.
Figure 3:
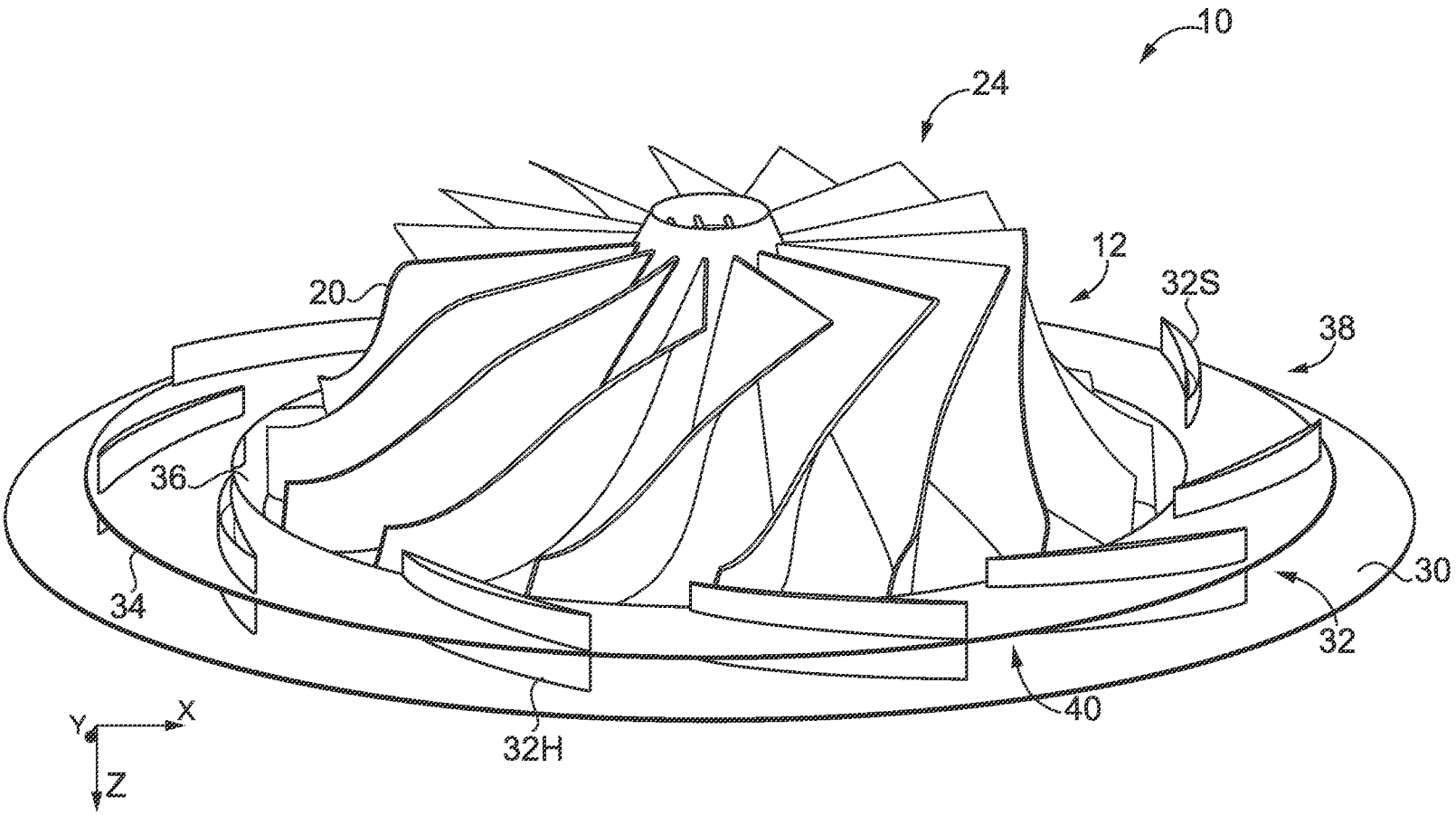
FIG. 3 illustrates some aspects of a non-limiting example of a centrifugal compressor system with a common splitter ring in accordance with an embodiment of the present invention.

Referring to FIGS. 1-3, some aspects of a non-limiting example of a centrifugal compressor system 10 are schematically illustrated in accordance with an embodiment of the present invention. Compressor system 10 is constructed to compress gaseous and/or vaporous fluids, e.g., air and/or other gases or vapors. Compressor system 10 includes a centrifugal impeller 12, an impeller shroud 14, a diffuser 16 and a flow collector 18. In one form, flow collector 18 is a volute. In other embodiments, flow collector 18 may take other forms.

Centrifugal impeller 12 includes a plurality of compressor blades 20 constructed to compress the gaseous and/or vaporous fluid. Compressor blades 20 may be, for example, affixed to or integral with an impeller hub 22 of centrifugal impeller 12. Shroud 14 is disposed on the opposite side of compressor blades 20 than hub 22.

Shroud 14 is in cooperative engagement with impeller 12, in particular, with compressor blades 20, for compression of the gaseous and/or vaporous fluid. In one form, shroud 14 is stationary, in which case a desired clearance with respect to compressor blades 20 is maintained during the operation of compressor system 10. In other embodiments, shroud 14 may be rotating, and may be, for example, a part of impeller 12 or affixed to impeller 12, e.g., affixed to compressor blades 20. Impeller 12 includes an inducer 24 for inducing flow into impeller 12. Impeller 12 also includes an exducer 26 for discharging compressed flow into diffuser 16.

Diffuser 16 includes a shroud surface 28, a hub surface 30, a plurality of diffuser vanes 32, and a common splitter ring 34. Shroud surface 28 and hub surface 30 define a diffuser flowpath 36 therebetween, bounded on two sides by shroud surface 28 and hub surface 30. Diffuser vanes 32 are spaced apart from each other circumferentially about diffuser 16, e.g., evenly spaced from each other, and extend between hub surface 30 and shroud surface 28. In one form, diffuser vanes 32 are affixed to hub surface 30 and shroud surface 28. In other embodiments diffuser vanes 32 may be affixed to hub surface 30 or shroud surface 28 and/or another supporting structure. Common splitter ring 34 is disposed between hub surface 30 and shroud surface 28. Common splitter ring 34 intersects each of the diffuser vanes 32 along the span of each diffuser vane 32. Common splitter ring 34 is constructed to subdivide the diffuser flowpath 36 into two parallel sub-flowpaths 38 and 40. In some embodiments, flow discharged from exducer 26 is approximately equally divided between sub-flowpaths 38 and 40. In other embodiments, the flow split may not be equal.

Impeller 12 has an axis of rotation 42. Common splitter ring 34 is a body of revolution about axis of rotation 42. Common splitter ring 34 is a continuous 360° ring. Common splitter ring 34 is referred to as a "common" splitter ring because it is common to all diffuser vanes 32, that is, it intersects or bisects all of the diffuser vanes 32. Common splitter ring 34 bisects diffuser vanes 32 into two diffuser vane sections: hub side vane section 32H and shroud side vane section 32S. In one form, each diffuser vane has a trailing edge 44 that extends radially outward of common splitter ring 34. In other embodiments, common splitter ring 34 may extend radially outward of trailing edges 44. In one form, each diffuser vane 32 has a leading edge 46 extending radially inward of common splitter ring 34. In other embodiments, common splitter ring 34 may extend radially inward of leading edges 46.

In one form, common splitter ring 34 has an aerodynamic cross-section. For example, in the illustration of FIG. 1, common splitter ring 34 has an aerodynamic cross-section in the form of a flat plate 48 with tapered leading edges 50 and tapered trailing edges 52. In some embodiments, e.g., as illustrated in FIG. 2, common splitter ring 34 may have an aerodynamic cross-section in the form of an airfoil 54 shape.

FIG. 3 illustrates some aspects of a non-limiting example of compressor system 10 with impeller shroud 14, diffuser shroud surface 28 and flow collector 18 not shown in order to illustrate centrifugal impeller 12, diffuser vanes 32 and common splitter ring 34. FIG. 3 illustrates the 3600 nature of common splitter 34, and illustrates the circumferentially spaced arrangement of diffuser vanes 32. Common splitter ring 34 is constructed to reduce shroud to hub motion of the flow in diffuser 16, and thus reduce cross-flow between hub surface 30 and shroud surface 28, and between shroud surface 28 and hub surface 30. The cross-slow is minimized in the diffuser space, e.g., in the diffuser vane spanwise direction, which in turn stabilizes the flow in the vaneless space upstream of the diffuser vanes. Minimizing cross-flow between the shroud surface 28 and hub surface 30 reduces secondary vortices that otherwise (i.e., in the absence of a common splitter ring 34) normally are formed downstream of the leading edge of diffuser vanes 32. Common splitter ring 34 thus enhances pressure recovery in the diffuser space.

Embodiments of the present invention include a compressor system, comprising a centrifugal impeller; a shroud in cooperative engagement with the impeller; and a diffuser having a hub surface; a shroud surface; a plurality of diffuser vanes extending between the hub surface and the shroud surface; and a common splitter ring disposed between the hub surface and the shroud surface and intersecting each of the diffuser vanes along a span of each of the diffuser vanes.

In a refinement, the hub surface and the shroud surface define a diffuser flowpath therebetween; and wherein the common splitter ring is constructed to subdivide the diffuser flowpath into two parallel sub-flowpaths.

In another refinement, the impeller has an axis of rotation; and wherein the common splitter ring is a body of revolution about the axis of rotation.

In yet another refinement, the common splitter ring is a continuous 360° ring.

In still another refinement, each diffuser vane has a trailing edge extending radially outward of the common splitter ring.

In yet still another refinement, each diffuser vane has a leading edge extending radially inward of the common splitter ring.

In a further refinement, the common splitter ring has an aerodynamic cross-section.

In a yet further refinement, the aerodynamic cross-section is a flat plate with tapered leading and trailing edges.

In a still further refinement, the aerodynamic cross-section is an airfoil shape.

In a yet still further refinement, the common splitter ring is constructed to reduce cross-flow between the hub surface and the shroud surface.

Embodiments of the present invention include a diffuser for a centrifugal compressor system, comprising: a hub surface; a shroud surface; and a common splitter ring disposed between the hub surface and the shroud surface.

In a refinement, the diffuser further comprises a plurality of diffuser vanes extending between the hub surface and the shroud surface and intersecting each of the diffuser vanes along a span of each of the diffuser vanes.

In another refinement, the hub surface and the shroud surface define a diffuser flowpath therebetween; and wherein the common splitter ring is constructed to subdivide the diffuser flowpath into two parallel sub-flowpaths.

In yet another refinement, the centrifugal compressor system include an impeller, wherein the impeller has an axis of rotation; and wherein the common splitter ring is a body of revolution about the axis of rotation.

In still another refinement, the common splitter ring is a continuous 360° ring.

In yet still another refinement, each diffuser vane has a trailing edge extending radially outward of the common splitter ring.

In a further refinement, each diffuser vane has a leading edge extending radially inward of the common splitter ring.

In a yet further refinement, the common splitter ring has an aerodynamic cross-section in the form of a flat plate with tapered leading and trailing edges.

In a still further refinement, the common splitter ring has an aerodynamic cross-section in the form of an airfoil shape.

In a yet still further refinement, the common splitter ring is constructed to reduce cross-flow between the hub surface and the shroud surface.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A centrifugal compressor system, comprising a single-sided centrifugal impeller having a front side that includes a plurality of compressor blades and a back side that lacks a plurality of compressor blades;

a shroud in cooperative engagement with the impeller; and a diffuser having a hub surface adjacent to the back side of the single-sided centrifugal impeller; a shroud surface adjacent to the front side of the single-sided centrifugal impeller; a plurality of diffuser vanes extending between the hub surface and the shroud surface; and a common splitter ring disposed between the hub surface and the shroud surface and intersecting each of the diffuser vanes at a point of the diffuser vanes located between a hub surface end of the diffuser vanes and a shroud surface end of diffuser vanes such that a flow into the diffuser is split by the common splitter ring into a first portion and a second portion;

wherein the common splitter ring is structured to increase compression efficiency by reducing motion of flow between the hub surface and shroud surface, the compression efficiency being increased relative to a centrifugal compressor system that lacks the common splitter ring.

2. The centrifugal compressor system of claim 1, wherein the hub surface and the shroud surface define a diffuser flowpath therebetween; and wherein the common splitter ring is constructed to subdivide the diffuser flowpath into two parallel sub-flowpaths.

3. The centrifugal compressor system of claim 1, wherein the impeller has an axis of rotation; and wherein the common splitter ring is a body of revolution about the axis of rotation.

4. The centrifugal compressor system of claim 1, wherein the common splitter ring is a continuous 360° ring.

5. The centrifugal compressor system of claim 1, wherein each diffuser vane has a trailing edge extending radially outward of the common splitter ring.

6. The centrifugal compressor system of claim 1, wherein each diffuser vane has a leading edge extending radially inward of the common splitter ring.

7. The centrifugal compressor system of claim 1, wherein the common splitter ring has an aerodynamic cross-section.

8. The centrifugal compressor system of claim 7, wherein the aerodynamic cross-section is a flat plate with tapered leading and trailing edges.

9. The centrifugal compressor system of claim 7, wherein the aerodynamic cross-section is an airfoil shape.

10. The centrifugal compressor system of claim 1, wherein the common splitter ring is constructed to reduce cross-flow between the hub surface and the shroud surface.

11. A centrifugal compressor system, comprising:

a single-sided centrifugal impeller having a front side that includes a plurality of compressor blades and a back side that lacks a plurality of compressor blades, a hub surface disposed on the back side of the single-sided centrifugal impeller;

a shroud surface disposed on the front side of the centrifugal impeller;

a common splitter ring disposed in a diffuser space of the centrifugal compressor system between the hub surface and the shroud surface and structured to receive an out flow from the single-sided centrifugal impeller during operation of the single-sided centrifugal impeller; and a plurality of diffuser vanes extending between the hub surface and the shroud surface and where the common splitter ring intersects each of the plurality of diffuser vanes at a point of each of the plurality of diffuser vanes between the hub surface and the shroud surface such that a flow into the diffuser space is split by the common splitter ring into a first portion and a second portion;

wherein pressure recovery is increased in the diffuser space relative to a configuration of the centrifugal compressor system that lacks the common splitter ring.

12. The centrifugal compressor system of claim 11, wherein the hub surface and the shroud surface define a diffuser flowpath therebetween; and wherein the common splitter ring is constructed to subdivide the diffuser flowpath into two parallel sub-flowpaths.

13. The centrifugal compressor system of claim 11, wherein the impeller has an axis of rotation; and wherein the common splitter ring is a body of revolution about the axis of rotation.

14. The centrifugal compressor system of claim 11, wherein the common splitter ring is a continuous 360° ring.

15. The centrifugal compressor system of claim 11, wherein each diffuser vane has a trailing edge extending radially outward of the common splitter ring.

16. The centrifugal compressor system of claim 11, wherein each diffuser vane has a leading edge extending radially inward of the common splitter ring.

17. The centrifugal compressor system of claim 11, wherein the common splitter ring has an aerodynamic cross-section in the form of a flat plate with tapered leading and trailing edges.

18. The centrifugal compressor system of claim 11, wherein the common splitter ring has an aerodynamic cross-section in the form of an airfoil shape.

19. The centrifugal compressor system of claim 11, wherein the common splitter ring is constructed to reduce cross-flow between the hub surface and the shroud surface.

20. The centrifugal compressor system of claim 1, wherein the common splitter ring is structured to reduce secondary vortices that are formed downstream of a leading edge of a diffuser vane of the diffuser vane relative to a centrifugal compressor system that lacks the common splitter ring.

* * * * *